US005890922A

United States Patent [19]

Buchter et al.

[11] Patent Number: 5,890,922

[45] Date of Patent: Apr. 6, 1999

[54] ELECTRICAL CONNECTOR

[75] Inventors: Randolph Lee Buchter; Kenneth Foster Folk, both of Harrisburg; Darrell Lynn Wertz, York, all of Pa.

[73] Assignee: The Whitaker Corporation, Wilmington, Del.

[21] Appl. No.: 918,809

[22] Filed: Aug. 26, 1997

Related U.S. Application Data

[60] Provisional application No. 60/030,543, Sep. 11, 1996.

[51] Int. Cl. [6] ..... H01R 13/28

[52] U.S. Cl. ..... 439/284; 439/556

[58] Field of Search ..... 439/284, 557, 439/556, 362, 533, 564, 565

[56] References Cited

U.S. PATENT DOCUMENTS

| | | | |
|---|---|---|---|
| 2,384,267 | 9/1945 | Andersen | 439/284 |
| 2,655,638 | 10/1953 | Allen | 439/271 |
| 3,747,048 | 7/1973 | Johnson et al. | 439/276 |
| 4,108,524 | 8/1978 | Seligmann | 439/284 |
| 4,114,970 | 9/1978 | Hall, Jr. | 439/294 |
| 4,179,179 | 12/1979 | Lowden | 439/278 |
| 4,630,876 | 12/1986 | Grunberg et al. | 439/293 |
| 4,990,099 | 2/1991 | Marin et al. | 439/284 |
| 5,123,862 | 6/1992 | Suzuki | 439/533 |
| 5,125,848 | 6/1992 | Zimmerly | 439/291 |
| 5,161,985 | 11/1992 | Ramsey | 439/74 |
| 5,660,564 | 8/1997 | Yamanashi et al. | 439/556 |

FOREIGN PATENT DOCUMENTS

0452555A1 10/1991 European Pat. Off. ..... H01R 23/27

OTHER PUBLICATIONS

International Search Report, Corresponding PCT/US 97/15879; Mailed Nov. 27, 1997 (Three pages).

*Primary Examiner*—Steven L. Stephan
*Assistant Examiner*—T C Patel
*Attorney, Agent, or Firm*—Katherine A. Nelson; Mary K. VanAtten

[57] ABSTRACT

An electrical connector (20) includes a dielectric housing (22) having a mating face (24) and a pair of contacts (44,54) disposed therein. Each contact (44,54) has a contact section (46,56) exposed at the mating face (24). The first contact section (46) is associated with a forwardly extending shroud (26) spaced from and circumscribing the first contact section (46). The second contact section (56) is associated with a forwardly extending silo (28) closely surrounding the second contact section (56). The second contact section (56) is complementary to the first contact section (46) and the silo (28) is complementary to the shroud (26), whereby the connector mating face (24) is hermaphroditic.

19 Claims, 4 Drawing Sheets

ELECTRICAL CONNECTOR

This application claims benefit of Provisional Appl. 60/030,543, filed Sep. 11, 1996.

FIELD OF THE INVENTION

This invention relates to electrical connectors and more particularly to connectors that can be sealed against moisture and dirt.

BACKGROUND OF THE INVENTION

In many instances it is desirable to connect an electrical cable to a substrate, such as a circuit board, a panel, or a bulkhead or other structure that is exposed to environmental conditions of temperature, moisture and dirt. Additionally, the cable and connectors may need to withstand physical shock and vibration.

It is desirable, therefore, to have a rugged connector to meet the various physical requirements and, in addition, to be cost effective to manufacture.

SUMMARY OF THE INVENTION

The present invention is directed to an electrical connector having a dielectric housing with a mating face and a pair of contacts disposed in the housing. Each of the contacts has a contact section exposed at the mating face for electrically engaging complementary contacts of another connector upon mating. A first contact is associated with a first side of the housing, which defines a forwardly extending shroud spaced from and circumscribing a first contact section at least about adjacent peripheral portions of the mating face. The second contact of the pair is associated with a second side of the housing, which defines a forwardly extending silo closely surrounding the second contact section. The second contact section is complementary to the first contact section and the silo is complementary to the shroud. The connector mating face is, therefore, hermaphroditic and is complementary to a mating face of a like connector thus enabling axially oriented mating therewith. In one embodiment the connector may be mounted to a substrate, such as a bulkhead using a seal between the connector and the bulkhead. Alternatively, the connector may be mounted in a mechanical apparatus having an electrically powered system. The connector may also be terminated to a cable and in the preferred arrangement the cable connector further includes a second housing for receiving the connector subassembly therein. The second housing is made of resilient material and extends forwardly at the mating face of the second connector such that when the first and second connectors are mated to one another the outer housing of the cable connector forms a seal around the mating face of the hermaphroditic connectors thus sealing the connector against environmental contamination and also seals against the bulkhead. To protect the mating interface against vibration and/or accidental separation an additional bracket may be disposed over the cable connector to act as a strain relief for the cable as well as to secure the mating connector to the bulkhead or apparatus.

It is an object of the present invention to provide a sealed electrical connector that is cost effective to manufacture and provides protection against contamination.

An embodiment of the invention will now be described with relation to the accompanying drawings.

DETAILED DESCRIPTION OF EMBODIMENTS OF THE INVENTION

Figure 1:
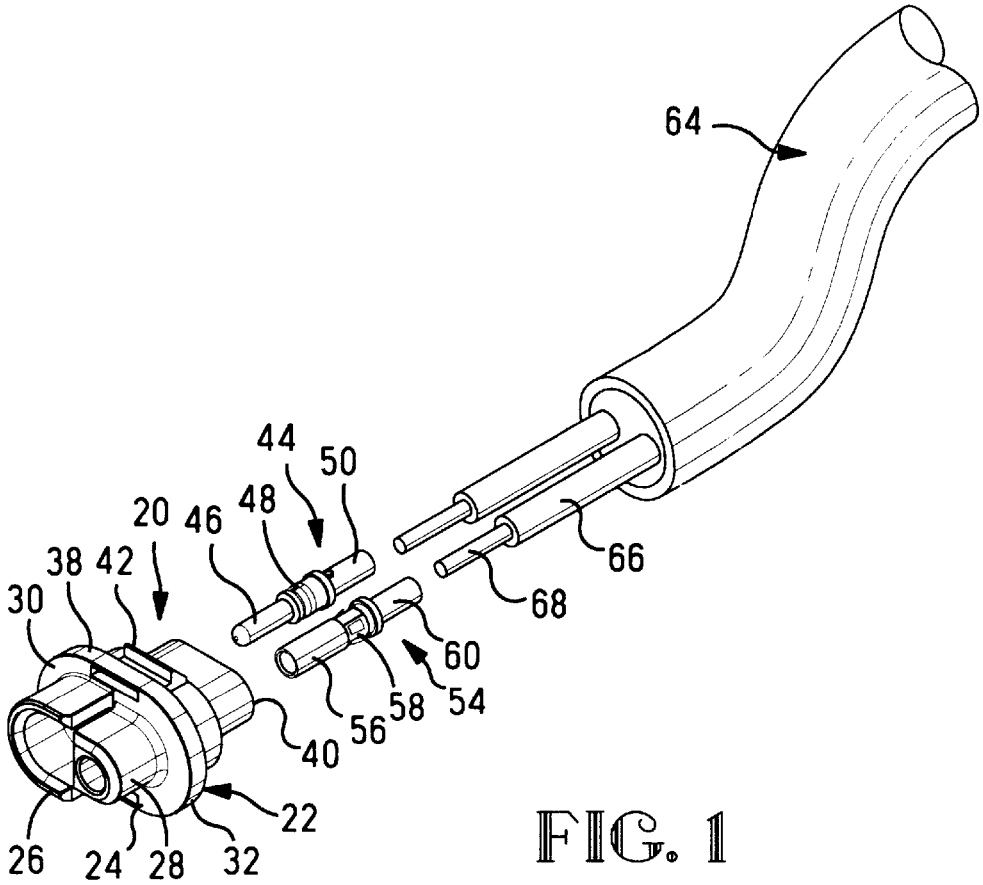
FIG. 1 is a perspective view of a connector made in accordance with the invention with the parts exploded.
Figure 2:
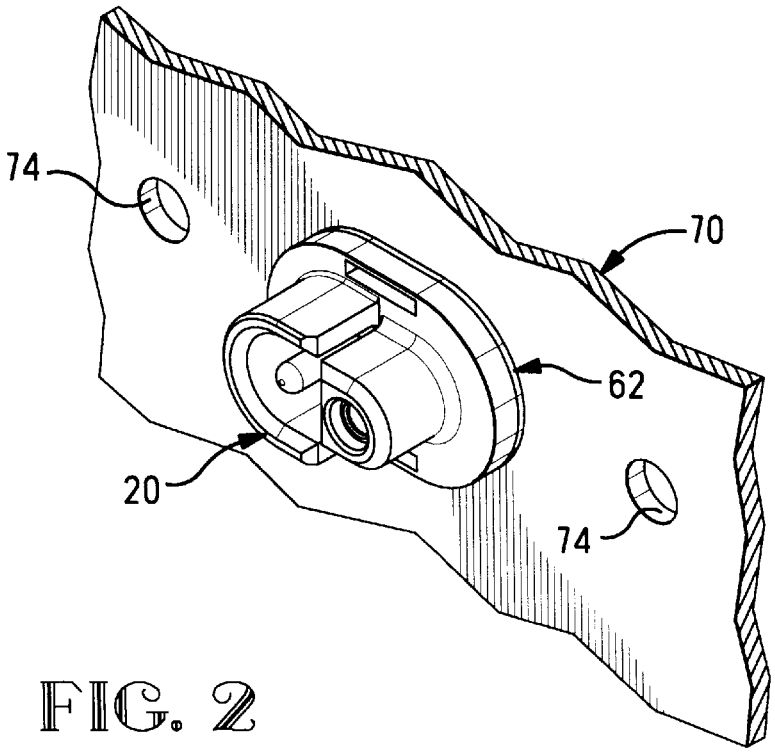
FIG. 2 is perspective view of the assembled connector of FIG. 1 mounted to a substrate.
Figure 3:
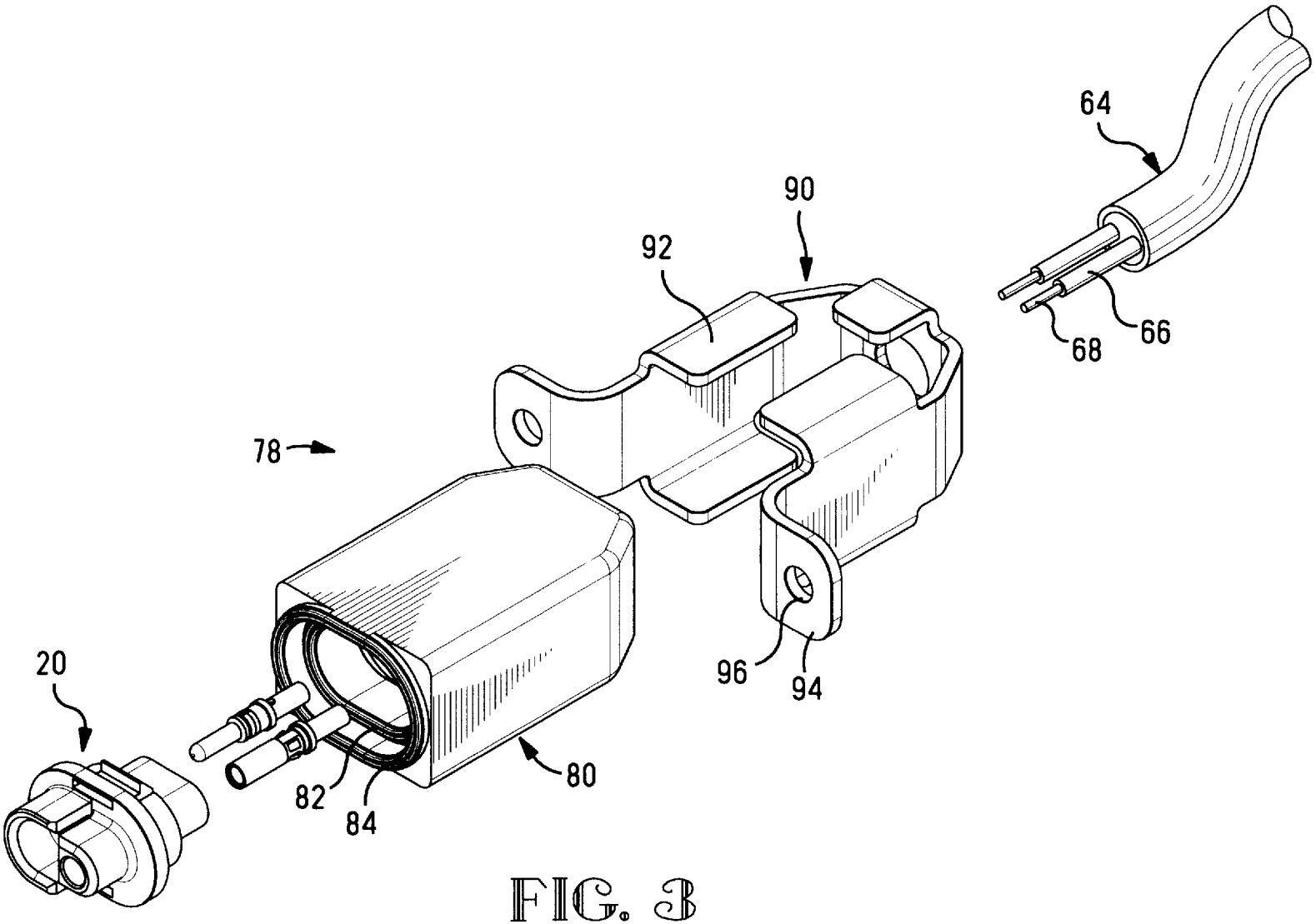
FIG. 3 is a perspective view of a cable connector with the parts exploded.
Figure 4:
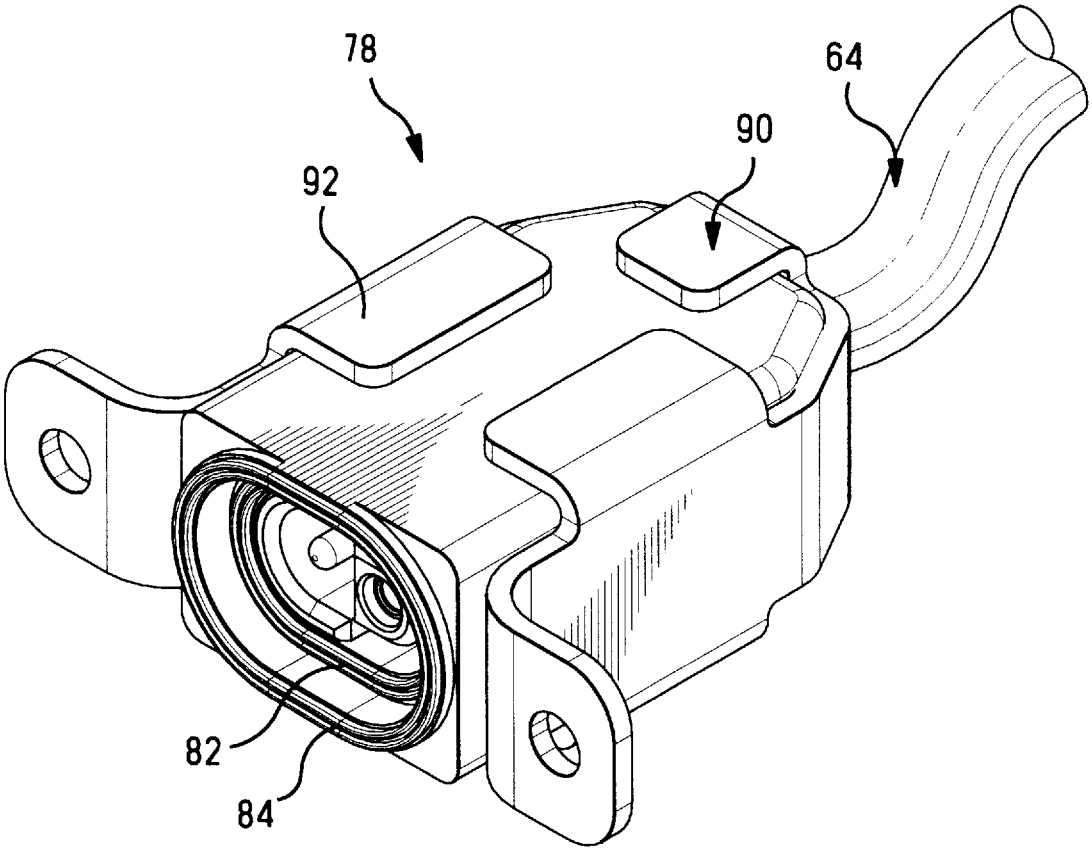
FIG. 4 is the assembled cable connector of FIG. 3.
Figure 5:
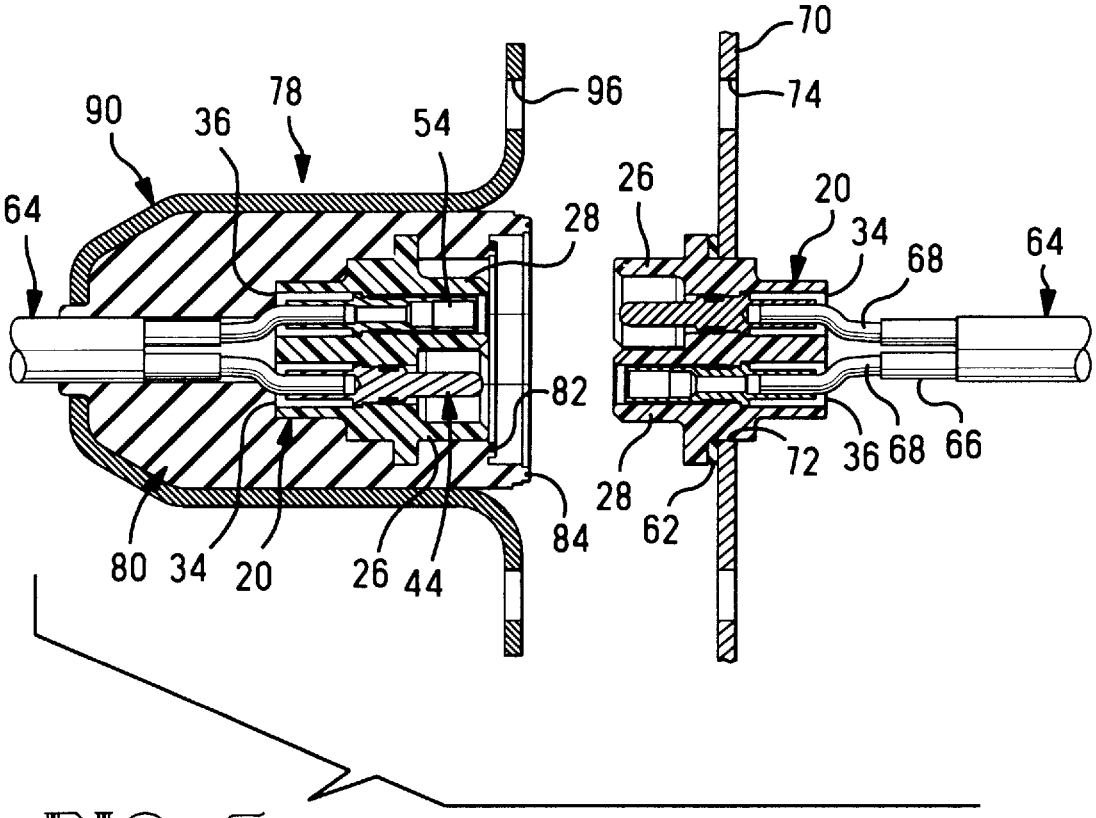
FIG. 5 is a cross-sectional view of a first connector secured to a substrate and the mating cable connector.

Referring now to FIGS. 1 through 6, connector 20 includes a housing 22 having a mating face 24, an opposed assembly face 40 and a pair of first and second contacts 44,54 secured in passageways 34,36 extending between the mating and assembly faces. First contact 44 has a contact section 46 exposed at the mating face 24 of the housing, a body 48 and a terminating section 50. Second contact 54 has a contact section 56 exposed at the mating face 24 thereof, a body 58 and a terminating section 60. The first contact section 46 is associated with a first side 30 of the housing 22, which defines a forwardly extending shroud 26 that circumscribes the first contact section 46 at least about adjacent peripheral portions of the mating face 24. The second contact section 56 is associated with a second side 32 of the housing, which has a forwardly extending silo 28 closely surrounding second contact section 56. Housing 22 further includes an outwardly extending flange 38 and a pair of latches 42 for securing connector 20 to a bulkhead or apparatus. As is shown in FIGS. 1 and 5, connector 20 is designed to have first and second contacts 44,54 terminated to a cable 64 having two insulated conductors 66 having exposed wire ends 68. In accordance with the present invention, the second contact section 56 is complementary to the first contact section 46 and the silo 28 is complementary to the shroud 26. Connector mating face 24 is, therefore, hermaphroditic and is complementary to a mating face of a like connector 20 thus enabling axially oriented mating therewith.

For purposes of illustrating the invention, the connector will be discussed as being mounted to a bulkhead. It is to be understood that the term "bulkhead", as used herein, includes substrates, such as circuit boards, panels and other such surfaces. In one embodiment of the invention, one connector 20 may be mounted in an aperture 72 of a bulkhead 70 or other apparatus. Preferably a seal 62 is used between the housing flange 38 and the surface of the bulkhead 70.

FIGS. 3 and 4 show a mating connector 20 as part of a cable connector assembly 78, which further includes a second housing 80 disposed around connector 20 and a clamp or bracket 90 for securing connector assembly 78 to the bulkhead 70. Housing 80 includes protrusions 82 and 84 extending forwardly from the front face thereof. Preferably the second housing 80 is made of resilient material so that upon mating cable connector assembly 78 to the connector 20 protrusions 82 and 84 will seal the interface at two locations. The second connector housing 80 may be made as an individual piece or it may also be overmolded around connector 20. A metal bracket 90, clamp, or the like, having retention tabs 92 may be secured around the outer surface of housing 80 to complete the assembly.

Figure 6:
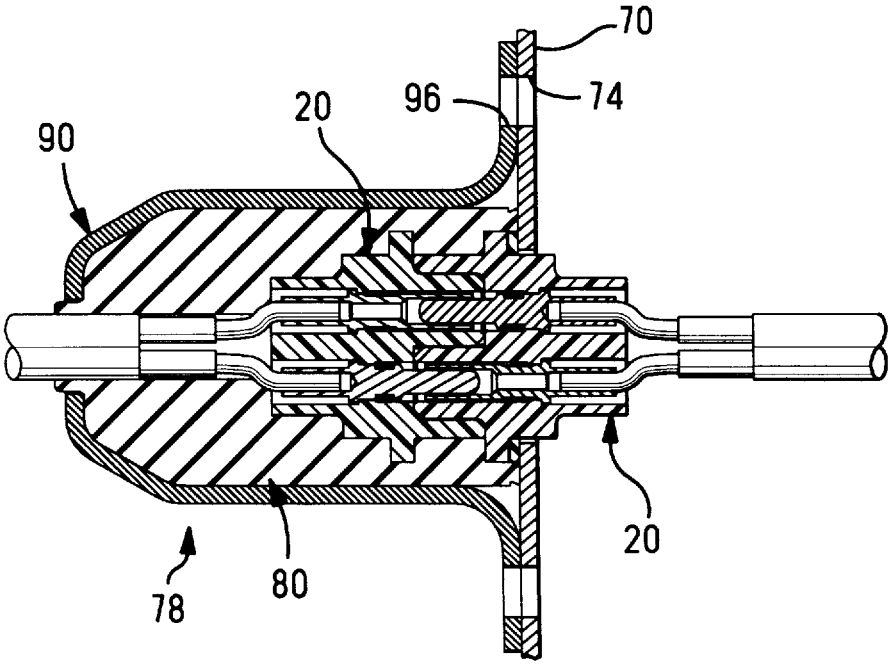
FIG. 6 is a cross-sectional view of the mated assembly of FIG. 5.

As shown in FIGS. 5 and 6, the cable assembly 78, including the mounting bracket or clamp 90, is then secured to the bulkhead 70. Upon mating the connector 20 on bulkhead 70 with the cable connector 78, the hermaphroditic connectors 20 mate with each other. The bracket 90 then can be secured to the bulkhead or apparatus by aligning respective mounting holes 74,96 and using fasteners (not shown) as known in the art. As best seen in FIG. 6 the first sealing portion 82 is pressed against the surface of flange 38 to provide sealing between the mating connectors 20 and the second sealing portion 84 is pressed against the surface of the bulkhead 70 thus sealing the two connectors 20 at two locations therealong to provide protection from contamination.

The present invention uses the hermaphroditic connectors to provide electrical interconnection. This is a cost effective method of manufacturing since only one mating portion need be manufactured. It is further to be recognized that the first and second connectors may be mated directly without having the additional housing 80 in which case latches can be used to secure the two connectors together. Using the hermaphroditic connectors at both ends of a cable further simplifies interconnecting electrical devices with the cable because either end of the cable may be used to mate with the connector in the device.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An electrical connector comprising:

a dielectric housing having a mating face; and a pair of contacts disposed in said housing, each of said contacts having a contact section exposed at said mating face for electrically engaging complementary contacts of another connector upon mating;

a first one of said pair of contacts being associated with a first side of said housing, said first housing side defining a forwardly extending shroud spaced from and circumscribing said first contact section at least about adjacent peripheral portions of said mating face, said shroud having at least one wall facing inwardly toward said first contact;

a second one of said pair of contacts being associated with a second side of said housing, said second housing side defining a forwardly extending silo closely surrounding said second contact section, said silo having an outwardly extending wall and at least a portion of the outwardly extending wall coincides with the at least one wall facing inwardly in the shroud, said second contact section being complementary to said first contact section and said silo being complementary to said shroud;

whereby said connector mating face is hermaphroditic and is complementary to a mating face of a like connector enabling axially oriented mating therewith.

2. The connector of claim 1 wherein one of said pair of contacts is a socket and the other of said pair is a pin terminal.

3. The connector of claim 2 wherein said socket is centered within said silo and said pin is centered within said shroud spaced from said silo.

4. The connector of claim 1 wherein said connector includes a flange extending laterally outwardly to define a rearwardly facing surface, remote from said mating face, for mounting to a substrate at an opening therethrough.

5. The connector of claim 4 further including at least one latching member spaced a selected distance rearwardly of said flange, said latching member adapted to engage an opposite surface of said substrate to hold said connector to said substrate.

6. The connector of claim 1 wherein said contacts further include terminating sections terminated to a cable and said connector further includes another dielectric housing disposed around said connector and portions of said cable, said another housing defining an outer shroud surrounding said mating face of said connector and extending forwardly thereof.

7. An electrical connector assembly comprising:

first and second matable connectors, each first and second connector including a respective dielectric housing having a mating face and a pair of contacts disposed in said housing, each of said contacts having a contact section exposed at said mating face for electrically engaging complementary contacts of the other connector upon mating;

a first one of said pair of contacts being associated with a first side of said housing, said first housing side defining a forwardly extending shroud spaced from and circumscribing said first contact section at least about adjacent peripheral portions of said mating face, said shroud having at least one wall facing inwardly toward the said first contact; and a second one of said contacts being associated with a second side of said housing, said second housing side defining a forwardly extending silo closely surrounding said second contact section, said second contact section being complementary to said first contact section and said silo being complementary to said shroud, said silo having an outwardly extending wall and at least a portion of the outwardly extending wall coincides with the at least one wall facing inwardly in the shroud;

whereby each said connector mating face is hermaphroditic and is complementary to a mating face of the other said connector enabling axially oriented mating therewith.

8. The electrical connector assembly of claim 7 wherein one of said pair of contacts is a socket and the other of said pair is a pin.

9. The connector of claim 8 wherein said socket is centered within said silo and said pin is centered within said shroud spaced from said silo.

10. The electrical connector assembly of claim 7 wherein said second connector includes a flange extending laterally outwardly to define a rearwardly facing surface, remote from said mating face, for mounting to a substrate at an opening therethrough.

11. The electrical connector assembly of claim 10 further including at least one latching member spaced a selected distance rearwardly of said flange, said latching member adapted to engage an opposite surface of said substrate to hold said connector to said substrate.

12. The electrical connector assembly of claim 10 wherein said contacts of said first connector include terminating sections terminated to a cable and said first connector further includes another dielectric housing disposed around said first connector and portions of said cable, said another housing of said first connector defining a shroud surrounding said mating face thereof, whereby when said second connector is mounted to a substrate, upon mating said first connector to said second connector, said shroud of said first connector abuts said substrate surrounding said mating face of said second connector.

13. The electrical connector assembly of claim 12 wherein said another housing includes a sealing portion at a forward end thereof such that upon mating said first connector to said second connector, said sealing member seals with said substrate and the mating interface of said first and second connectors.

14. The electrical connector assembly of claim 12 further including a clamp, securable around said another housing and mountable to said substrate to hold said first connector to said substrate..

15. An electrical connector assembly comprising:

first and second matable connectors, each first and second connector including a respective dielectric housing having a mating face and at least one contact disposed in said housing, each of said contacts having a contact section exposed at said mating face for electrically engaging complementary contacts of the other connector upon mating;

a first one of said pair of contacts being associated with a first side of said housing, said first housing side defining a forwardly extending shroud spaced from and circumscribing said first contact section at least about adjacent peripheral portions of said mating face, said shroud having at least one wall facing inwardly toward the said first contact; and a second one of said contacts being associated with a second side of said housing, said second housing side defining a forwardly extending silo closely surrounding said second contact section, said second contact section being complementary to said first contact section and said silo being complementary to said shroud, said silo having an outwardly extending wall and at least a portion of the outwardly extending wall coincides with the at least one wall facing inwardly in the shroud;

said first connector further including another dielectric housing disposed around said connector defining an outer shroud surrounding said mating face of said connector and extending forwardly thereof;

whereby when said second connector is mounted to a substrate, upon mating said first connector to said second connector, said shroud of said first connector abuts said substrate surrounding said mating face of said second connector.

16. The electrical connector assembly of claim 15 wherein said another housing includes a sealing portion at a forward end thereof such that upon mating said first connector to said second connector, said sealing member seals with said substrate and the mating interface of said first and second connectors.

17. The electrical connector assembly of claim 15 wherein said another housing includes mounting portions outwardly of said shroud and essentially coplanar with the leading end thereof and adjacent said substrate enabling fastening of the mated assembly to the substrate.

18. The electrical connector assembly of claim 15 further including a seal secured between said second connector and said substrate, sealing the interface thereof.

19. The electrical connector assembly of claim 18 wherein said another housing includes a sealing portion at a forward end thereof such that upon mating said first connector to said second connector, said sealing member seals with said substrate and the mating interface of said first and second connectors.

* * * * *